United States Patent [19]

Gondo et al.

[11] 3,951,696

[45] Apr. 20, 1976

[54] METHOD FOR PRODUCING A HIGH-STRENGTH COLD ROLLED STEEL SHEET HAVING EXCELLENT PRESS-FORMABILITY

[75] Inventors: Hisashi Gondo; Hiroshi Takechi, both of Kisarazu; Hiroaki Masui, Kimitsu; Kazuo Namba, Kisarazu, all of Japan

[73] Assignee: Nippon Steel Corporation, Tokyo, Japan

[22] Filed: Aug. 8, 1974

[21] Appl. No.: 495,894

[30] Foreign Application Priority Data

Aug. 11, 1973 Japan ..... 48-90342

[52] U.S. Cl. ..... 148/12 R; 148/12 C; 148/12 F

[51] Int. Cl.[2] ..... C21D 7/02; C21D 9/46

[58] Field of Search ..... 148/12 R, 12 C, 12 F

[56] References Cited

UNITED STATES PATENTS

| | | | |
|---|---|---|---|
| 3,178,318 | 4/1965 | Shimizu et al. | 148/12 C |
| 3,357,822 | 12/1967 | Miyoshi et al. | 148/12 F |
| 3,830,669 | 8/1974 | Matsuoka | 148/12 F |
| 3,857,740 | 12/1974 | Gondo et al. | 148/12 F |

*Primary Examiner*—W. Stallard

*Attorney, Agent, or Firm*—Toren, McGeady and Stanger

[57] ABSTRACT

A method for producing a cold rolled steel sheet having high strength and stretchability which comprises hot rolling a steel containing 0.03 to 0.30% C, less than 0.7% Si, 0.6 to 2.5% Mn, 0.01 to 0.20% sol.Al, not more than 0.015% O with the balance being Fe and unavoidable impurities, cold rolling with a reduction not less than 30%, heating with an average heating rate not less than 3°C/sec. annealing in a temperature range from 650°C to $A_3$ transformation point for 1 to 15 minutes, and cooling with an average cooling rate of 0.5° to 30°C/sec. down to 500°C.

8 Claims, 4 Drawing Figures

(x 1,000)

(x 1,000)

Figure 1:
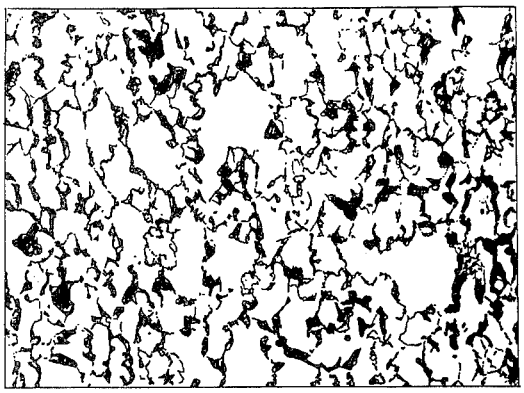

METHOD FOR PRODUCING A HIGH-STRENGTH COLD ROLLED STEEL SHEET HAVING EXCELLENT PRESS-FORMABILITY

The present invention relates to a method for producing a high-strength cold rolled steel sheet having 45 to 90 kg/mm$^2$ tensile strength and 35 to 75 kg/mm$^2$ yield strength and yet having good press-formability, particularly stretchability.

Recently demands have been increasingly made for development of a cold rolled steel sheet having still higher strength without substantially lowering press-formability as compared with the conventional cold rolled steel sheet for use in inside sheets and outside skins of a safety automobile. Particularly, for parts such as member sides which are subjected to severe stretching and bending and whose increased strength has a large effect on the safety, demands are increasingly made for a cold rolled steel sheet which has high strength such as 45 to 90 kg/mm$^2$ strength, 35 to 75 kg/mm$^2$ yield strength as well as excellent ductility such as stretchability and yet shows a high $\bar{r}$ value of drawability in certain applications.

Hitherto, it has been difficult to produce a cold rolled steel sheet which satisfies the above requirements of properties at low production cost.

Therefore, the object of the present invention is to provide a method for producing a cold rolled steel sheet having high strength and excellent press-formability as above.

The metallurgical principles of the present invention will be described hereinunder.

The method according to the present invention comprises hot rolling and cold rolling a low Si-Mn killed steel, heating the cold rolled steel sheet with an average heating rate not lower than 3°C/sec. annealing the steel sheet for a short time between 1 to 15 minutes at a temperature between 650°C and the $A_3$ transformation point, in which the cooling of the steel sheet is done at an average cooling rate between 0.5° and 30°C/sec. down to 500°C.

Although metallurgical explanation why the steel sheet produced according to the present invention has a high yield point and a high tensile strength is not completely clear, the following assumptions may be made.

In case of annealing between 650°C and the $A_1$ transformation point, the fine grains produced immediately after the recrystallization can not grow enough because of the rapid heating and the short-time annealing so that the yield point is raised due to the retained fine grains. At the same time, the specific elements such as C show only incomplete diffusion in the grain boundaries due to the rapid heating and the short-time annealing, and it is assumed their segregation in the grain boundaries increases so that the dependency coefficient of the yield strength on the grain diameter as revealed by Petch et al increases and the yield strength is improved.

Further, in case when the annealing temperature is limited to the range from the $A_1$ transformation point to the $A_3$ transformation point, it has been found that the strength, particularly tensile strength, remarkably increases and yet stretchability is also improved. These improvements may be explained as under from the metallurgical point of view.

By being heated and held at a temperature between the $A_1$ transformation point and the $A_3$ transformation point, the steel takes a two-phase structure of ferrite ($\alpha$) + austenite ($\gamma$) at high temperature, and if the steel is cooled at a relatively rapid cooling rate down to the $A_1$ transformation point or below, the austenite is converted into a hard phase such as troostite, sorbite, bainite and martensite, meanwhile the ferrite at the high temperature continues to form a soft ferrite phase even after the cooling. The complex structure of the above hard and soft phases is considered to remarkably enhance the tensile strength, and assure the excellent stretchability of the cold rolled steel sheet.

Although the steel composition of the present invention contains C and Mn as main components, elements such as Si and P other than C and Mn are also effective for enhancing the yield point due to their expected grain-boundary segregation, in view of the fact that the yield point is enhanced by the increased segregation of the specific elements in the grain boundaries due to the rapid heating and the short-time annealing in case of the annealing between 650°C and the $A_1$ transformation point. On the other hand, in case of the annealing between the $A_1$ transformation point and the $A_3$ transformation point, Si and P contribute to form the gamma loop at high temperatures, and thus are effective to expel the carbon in the ferrite into the austenite, and contribute to enhance the carbon concentration in the austenite at high temperature, increases the hardness of the hard phase produced after the cooling, hence increasing the strength of the final product.

Figure 2:
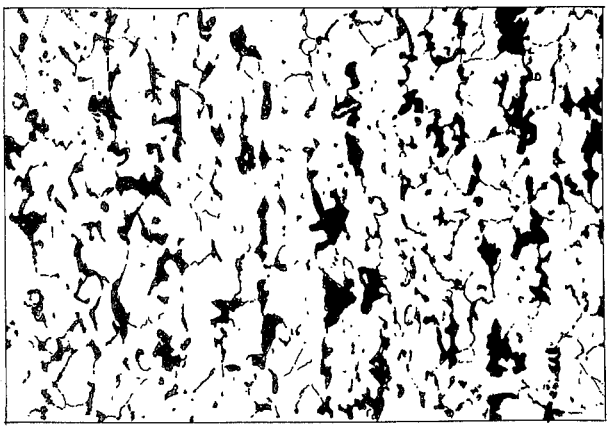

Now, the carbides at the annealing temperature not higher than the $A_1$ transformation point according to the present invention are all in the form of fine cementite. This cementite is produced when the pearlite etc. in the hot rolled steel sheet, which is broken during the cold rolling and dissolved during the annealing, is cooled. While, in case of the annealing between the $A_1$ transformation point and the $A_3$ transformation point, the hard structure is a structure produced by precipitation of very fine cementite in the ferrite matrix such as troostite and sorbite, or is bainite and martensite etc. In this point, it may be allowed that the hard phase and the soft phase are present in slightly laminated form, but it is necessary even in this case for attaining the required strength that the hard phase does not contain a typical pearlite in which the ferrite and the cementite are arranged clearly alternately. FIG. 1 shows a complex structure of a ferrite phase free from photo-microscopically visible carbide and a ferrite phase containing many visible fine carbides surrounding informly the carbide-free ferrite, and FIG. 2 shows a complex structure of ferrite and troostite, both representing an example of the present invention. As for the hard phase, the mechanical mixture of ferrite and the fine carbide such as troostite and sorbite is more stable than martensite and bainite in respect of strength against the cooling rate, and is more easy to produce.

Among the hard phases, troostite or sorbite becomes still further fine when the annealing temperature is taken between the $A_1$ transformation point and 790°C. Thus a complex structure is obtained in which a hard phase of visible fine carbides dispersed in the ferrite matrix is uniformly surrounding the ferrite of the soft phase as shown in FIG. 1. This indicates that not only very small anisotropy of mechanical properties within the steel plate plane but also uniform material properties in the plate thickness direction can be obtained.

In order to balance the strength and the ductility in a high level, it is desired that the hard phases are maintained not more than about 50% on the basis of the cross section-area ratio of the photo-microscopic structure, and in order to enhance the ductility it is desired that these hard phases are maintained not more than 30%.

As mentioned above, the steel composition according to the present invention contains C and Mn as essential components, and Si and P may be added. Further in case of the annealing between the $A_1$ transformation point and the $A_3$ transformation point, addition of B etc. is effective for suppressing precipitation of ferrite from the austenite and effective for hardening of the hard phase.

Also, a thin-gauge steel material such as a cold rolled steel sheet generally has good bending property, but as for the steel material to be used for small member parts which require severer bending property and are bent to a smaller bending radius than the member side etc., it is very effective to reduce elongated sulfide inclusions as small as possible, and for this purpose it is advantageous to add Zr, Ca, Mg and rare earth elements, and it is also found that addition of Cr, Ni, Cu etc. is effective for increasing the yield point and strength without sacrificing the ductility.

Reasons for the limitations of the steel composition and production method according to the present invention will be explained hereinafter.

C is an element necessary for increasing the steel strength, and for this purpose at least 0.03% C is required, but particularly in case of the annealing between the $A_1$ transformation point and the $A_3$ transformation point at least 0.06% C is required for producing much hard phase. Further in order to maintain the area of the hard phase more than about 10% desired for balancing the strength and the ductility, not less than 0.10% C is desirable. Also, in a simple steel composition containing mainly C and Mn according to the present invention, more than 0.15% C is desired for obtaining enough strength as a whole by increasing the hardness of the hard phase with a practical cooling rate according to the present invention. On the other hand, with a carbon content beyond 0.30%, the proportion of the hard phase becomes excessive, thus lowering the ductility. Also, with a carbon content beyond 0.25%, a large pearlite is easily formed during the hot rolling and thus a satisfactory complex structure can not be obtained in the final product due to local segregation of the carbon, thus causing damage of the balance between the strength and the ductility.

Regarding Mn, at least 0.6% Mn is necessary for maintaining a high level of strength, and not less than 1.0% Mn is desirable for obtaining a satisfactory complex structure in the final product by increasing the amount of austenite at high temperatures. On the other hand, Mn contents beyond 2.5% increases the hardenability of the steel, and a complex structure of appropriate combination is hardly obtained and enough ductility are not attained.

An excessive amount of Mn is not desirable, because a segregation layer of Mn is easily formed and a remarkable band structure is produced. Thus not less than about 1.8% Mn is desirable. In order to produce a mechanical mixture phase of ferrite and fine carbide such as troostite and sorbite which gives stable strength, less than 1.6% Mn is desirable.

Regarding Si, strengthening of the steel can be obtained even if Si is not intentionally added in the present invention, but Si is an element effective to form the gamma loop, and in case of the annealing between the $A_1$ transformation point and the $A_3$ transformation point not less than 0.1% Si is desired for formation of the ferrite phase containing no carbide by expelling the carbon. On the other hand, not less than 0.7% Si causes deterioration of the scale property of the steel sheet and thus scale patterns are retained on the cold rolled steel sheet, not only lowering lacquer and plating adhesion, and remarkably restricting the applications of the present invention, but also causing roll damages due the adhesion of Si onto rolls in the annealing furnace and thus prohibiting production of the steel of the present invention in a continuous annealing furnace.

Regarding P, the strengthening of the steel can be attained in the present invention even if P is not intentionally added. But P exerts similar effects as Si, and in case of the annealing between the $A_1$ transformation point to 790°C, P gives following effects when present together with Si.

As mentioned above, in case of the annealing between the $A_1$ transformation point and 790°C, a peculiar complex structure in which hard phases with visible fine carbides dispersed in the ferrite matrix surround uniformly the soft phase of ferrite containing no visible carbide is obtained. In this case, if P and Si are present in the following combination, the peculiar complex structure can be obtained more easily according to the present invention.

Both of P and Si are a gamma loop forming element, and they promote the formation of the ferrite phase containing no carbide by expelling the carbon. Particularly when P + Si is not less than 0.05% and P/C is not less than 0.5 and/or Si/C is not less than 1, the above uniform complex structure can be obtained more completely. Their corelation with the carbon content is important for the following reasons.

When the amount of P and Si which are effective to expel the carbon is too low as compared with the amount of C, their expelling force is weak, and thus a satisfactory complex structure is difficult to obtain.

Al is necessary for deoxidation of the steel, and at least 0.01% sol.Al is required, and not less than 0.02% is desired from the point of ageing property. On the other hand, excessive Al contents form alumina crusters, thus lowering the surface condition. Thus Al is limit to not more than 0.20% sol.Al. Meanwhile for prevention of hot embrittlement of the slab due to AlN, it is desirable to maintain Al in an amount not more than 0.1% sol.Al.

Regarding oxygen, not more than 0.015% O is desirable from the point of improvement of impact properties. Further, less than 0.010% is desirable from the point of preventing deterioration of the surface condition.

S is desired to be present in an amount not more than 0.012% for improvement of bending property and not more than 0.01% is desirable from the point of pressformability.

Although B is not necessarily added intentionally for attaining the required strength of the steel of the present invention, when B is contained, B which segregates in the austenite grain boundaries suppresses the precipitation of the ferrite, is effective for producing the hard phases such as not only martensite but also bainite, troostite and sorbite only with a relatively small cooling rate as 0.5°C/sec to 30°C/sec. In this case, at least 0.0005% B is required. Further, in order to suppress the ferrite precipitation from the austenite grain boundaries with a practically feasible average cooling rate of not higher than 10°C/sec so as to enhance the strength of the final product more than 0.0008% B is desirable. On the other hand, when B is contained in an amount exceeding 0.01% hot cracking is caused, and in order to eliminate completely edge cracks of the hot rolled steel plate not more than 0.006% B is desirable.

Other than the above elements, addition of one or more of the group A of solid solution hardening elements consisting of Cr, Ni, and Cu is effective for enhancing the yield point without substantial deterioration of the ductility when they are present in an amount not less than 0.03%, but more than 1.0% causes deterioration of the ductility.

Regarding Zr, Ca, Mg and rare earth elements which are respectively a sulfide former, they are useful when they are contained in an amount not less than 0.01% (amount to be added for the rare earth elements, Ca and Mg) because they improve bending property. However, when they are added in an amount beyond 0.1% they lower ductility.

The various limitations in the production conditions of the present invention will be set forth hereinunder.

The cold rolling reduction rate is an important feature of the present invention. While at least 30% reduction is enough for effecting the recrystallization with a short-time annealing in practice, it is effective to finely devide the carbides such as the pearlite at the stage of hot rolled steel plate for dissolving the carbon into solid solution satisfactorily, and for this purpose a cold rolling reduction not less than 50% is desirable. Meanwhile in order to obtain a recrystallization structure useful for drawability, not less than 60% of reduction is desirable, but in case when the cold rolling and the annealing are repeated twice enough drawability can be obtained by reduction not less than 40%.

Regarding the annealing step, particularly the heating rate, it is important that the complex steel structure of the present invention is obtained by merely promoting the diffusion of carbon into the austenite without producing the structure in which the ferrite and the austenite are clearly separated in a laminar form, at high temperatures even beyond the $A_1$ transformation point, and for this purpose at least an average heating rate not less than 3°C/sec. is required. On the other hand if the heating is excessively rapid, the recrystallization structure favourable to the drawability is difficult to obtain, and thus the average heating rate not higher than 30°C/sec. is desirable.

Next, regarding the annealing temperature, the recrystallization after the cold rolling is effected by continuous annealing and yet enough ductility is obtained by defining the lower limit of the annealing temperature as 650°C. However, as one of the features of the present invention is to improve the tensile strength by means of the complex structure of the soft phase composed of ferrite and the hard phase composed of troostite etc., it is desirable to effect the annealing at a temperature not lower than the $A_1$ transformation point. On the other hand, if the annealing temperature is higher than the $A_3$ transformation point, the structure is completely an austenite-straight structure and thus it is impossible to obtain the complex structure having good excellent balance between the strength and the ductility.

Meanwhile, in order to obtain the complex structure in which the hard phase having visible fine carbides dispersed in the ferrite-matrix, surrounds the soft ferrite phase, it is desirable to effect the annealing at a temperature between the $A_1$ transformation point and 790°C.

Regarding the annealing time, at least one minute annealing time is required for recrystallizing the cold rolled structure. On the other hand, if the annealing time is excessively long, the austenite and ferrite grains grow too coarse so that it is difficult to obtain the uniform complex structure, and thus an annealing time not longer than 15 minutes is desirable.

Meanwhile, it is not always necessary to hold the steel at the maximum annealing temperature, and it may be enough only to conduct the annealing in a gradient or stepwise manner. Namely it is satisfactory to the annealing for one to 15 minutes in the temperature range as defined before.

In case of the annealing between the $A_1$ transformation point and 790°C for obtaining the complex structure in which the hard phase having visible fine carbides dispersed in the ferrite matrix surrounds the soft ferrite phase as mentioned before, an annealing holding time not longer than 10 minutes is desirable in order to prevent the separation of the austenite and the ferrite in a clear laminar form at high temperatures.

Next, regarding the cooling rate which is one of the most important features of the present invention, somewhat rapid cooling is required for obtaining the martensite etc., but too rapid cooling cause many internal defects in the ferrite of the soft phase, and although the strength is enhanced considerably the ductility lowers considerably. Thus the average cooling rate down to 500°C is defined as not higher than 30°C/sec. Further, in order to improve the ductility with less internal defect, an average cooling rate not higher than 10°C/sec. is desirable. On the other hand, when the cooling rate is too small, the precipitation of carbon progresses during the cooling and a laminar pearlite or a similar carbide structure is produced so that the strength lowers considerably. Thus the lower limit of the cooling rate is defined to 0.5°C/sec.

What is particularly to be noted in the present invention is the cooling rate. The present invention is completely different from the method disclosed, for example, in the Japanese patent publication Sho 46-9542 in which the mixed structure of ferrite and martensite is obtained by such a rapid cooling that a cooling time from the heating temperature between the $A_1$ transformation point and the $A_3$ transformation point to the starting temperature of the martensite transformation, between 0.1 and 0.8 seconds. This difference is due to the difference in the steel composition, particularly the contents of Mn etc.

The main features in the production method according to the present invention have been described above, but for the purpose of improving the aging property of the final product by precipitating C and N in solid solution which are present in a small amount through a slightly rapid cooling after the annealing, it is very advantageous to effect a heat treatment, similar to an aging treatment, which comprises holding the steel for 2 to 20 minutes at a temperature between 250° and 600°C during the cooling from the annealing temperature or after the cooling. It has been found that it is possible to improve the drawability by conducting the two-time cold rolling — annealing method comprising cold rolling — annealing — cold rolling — annealing also in the present invention.

The present invention will be more clearly understood from the following examples.

EXAMPLE 1

Steel slabs were produced by melting in a converter, an ordinary ingot-making and partly by a continuous casting (Steels $A_2$ and $B_2$), and these slabs were subjected to hot rolling, cold rolling, annealing and overaging as shown in Table 1 to obtain cold rolled steel sheets of 1.0mm thickness. All of the products were subjected to skin-pass rolling of 1.0%. The chemical compositions, production conditions, mechanical properties, $\bar{r}$ values and secondary workability are shown in Table 1.

As for the secondary workability test, the following impact secondary workability test was conducted. A steel sheet disc of 80 to 160mm diameter was drawn into a cup-like form with an appropriate drawing ratio (primary working drawing ratio), and this cup-like test piece was immersed in a vessel containing water and ice to lower the temperature of the test piece fully, than a conical punch was inserted into the cup-like test piece on the thick steel plate and a steel lump of 20 kg weight was dropped from a height of 3m to the punch, to see if an embrittlement rapture (longitudinal crack) was caused in the test piece. In this test, a larger the largest primary working drawing ratio (limit drawing ratio) which does not cause the embrittlement crack represents better impact secondary workability. The secondary workability tends to lower in a steel sheet having higher strength. In case of an ordinary mild rimmed steel the limit drawing ratio is about 3.0 to 3.2.

As understood from Table 1, when the steel composition according to the present invention is worked into a cold rolled steel sheet by the production steps including the continuous annealing according to the present invention, it is possible to produce a high-strength cold rolled steel sheet having a high yield ratio of about 0.75 and yet excellent secondary workability or drawability.

Meanwhile, if the steel composition of the present invention is subjected to as box annealing at about 700°C, a high yield point can not be obtained although satisfactory drawability is obtained so that the utility of the present invention directed to the inside sheets and outside sheets of safety automobiles is remarkably limited.

In case of a box annealing, the grain growth is suppressed when the annealing is done at a low temperature as about 600°C and it is possible to obtain a somewhat high yield point property, but remarkable results as obtained by the rapid heating and the short-time annealing can not be expected.

EXAMPLE 2

Steel slabs were produced by melting the steel in a converter, and an ordinary ingot-making method, and these slabs were subjected to hot rolling, two-time cold rolling-annealing and overaging as shown in Table 2 to obtain cold rolled steel sheets of 0.8mm thickness. All of the products were subjected to skin-pass rolling of 1.0%. The chemical compositions of the steels, production conditions mechanical properties, $\bar{r}$ values and secondary workability are shown in Table 2.

As understood from the results shown in Table 2, the two-time cold rolling-annealing method is advantageous when a high drawability other than the high yield point property is particularly desired.

EXAMPLE 3

Steels having the chemical compositions shown in Table 3 were hot rolled at a finishing temperature of 870°± 20°C, and a coiling temperature of 625°C ± 30°C, cold rolled at 60% reduction, then heated to 840°C in a continuous annealing furnace at an average heating rate of 5.0°C/sec, held at the temperature for 2.5 minutes, cooled to 450°C with an average cooling rate of 3.0°C/sec down to 500°C, held at 450°C for 12 minutes, and rapidly cooled to the ordinary temperature. After the aging treatment at 450°C, 1.5% skin-pass rolling was done and the final thickness of the sheet was 1.0mm.

Mechanical properties and Erichsen test values of the products thus obtained are shown in Table 3. The Erichsen value represents the stretchability of the steel sheet, and a higher Erichsen value shows better stretchability. The mechanical properties were measured by test pieces prepared according to JIS No. 5. Also the results of rough measurements of the dimensional ratio of the hard phases in the photomicroscopic structure are shown in Table 3.

Figure 3:
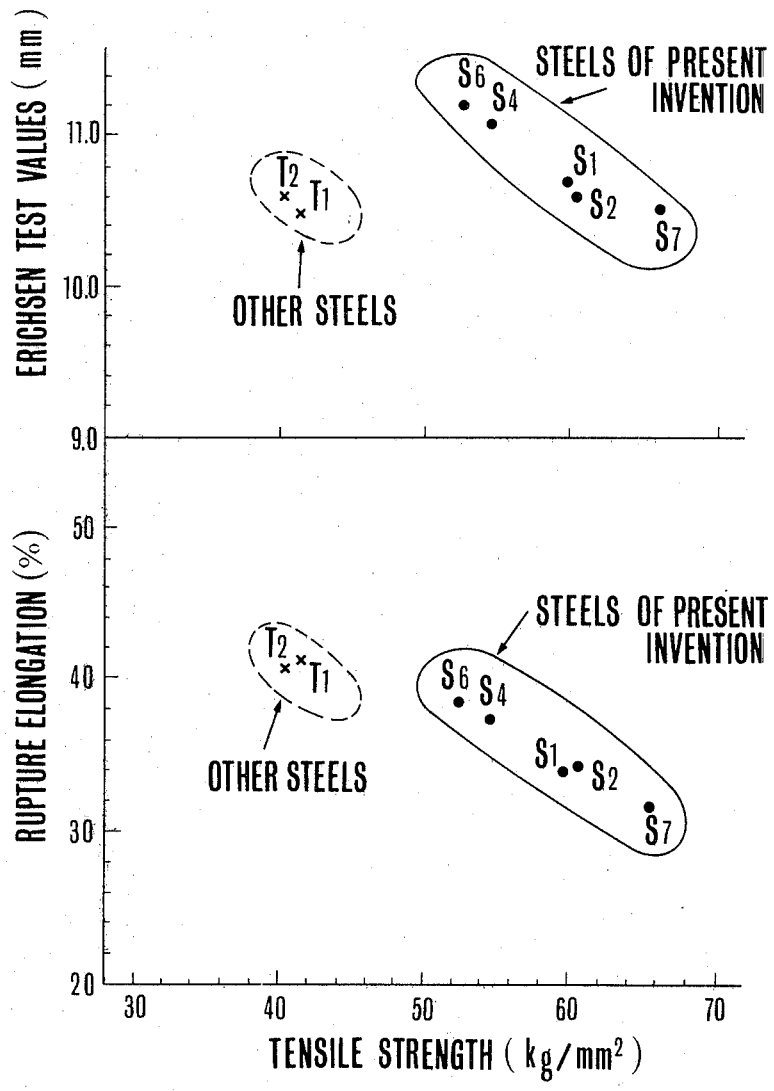

In FIG. 3, the balance among the tensile strength and the rupture elongation or the Erichsen value is plotted. It is understood from the figure that the steel of the present invention is very excellent in this point. Also the steel compositions of the present invention as shown in Table 3 show excellent elongation, which indicates a high workability, particularly good stretchability among the press-forming properties.

EXAMPLE 4

Steels having chemical compositions shown in Table 4 were hot rolled at a finishing temperature of 870°C ± 20°C and a coiling temperature of 620°C ± 20°C, cold rolled and annealed under the conditions shown in Table 5, and mechanical properties of the products thus obtained and the results of rough measurements of the dimensional ratio of hard phases are also shown in Table 5. All of the products were subjected to an aging treatment at 450°C in the course of the cooling of the annealing, and 1.5% skin-pass rolling after the aging treatment. The balance among the tensile strength, and the rupture elongation or Erichsen value shown in Table 5 is plotted in FIG. 4.

Figure 4:
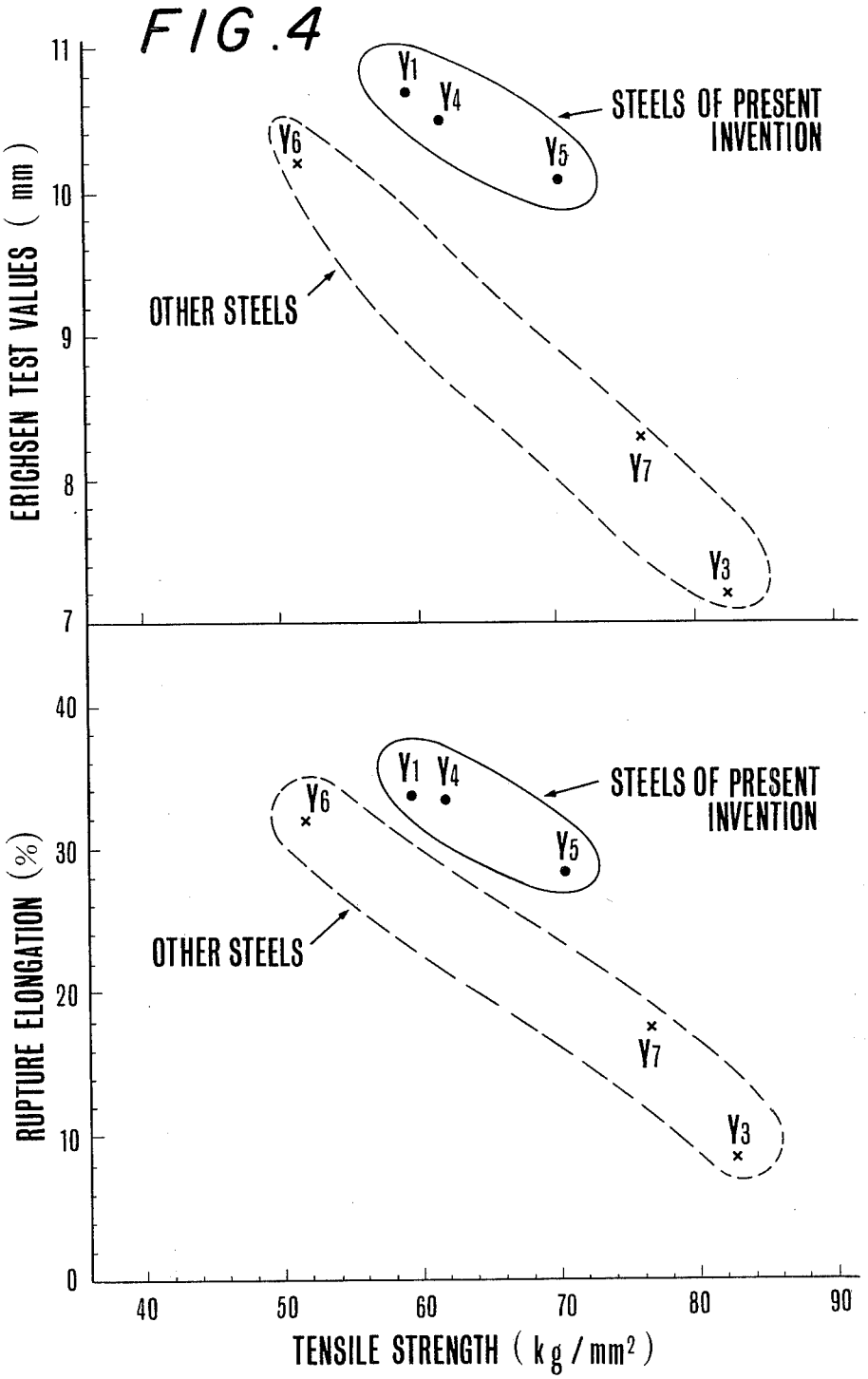

As seen in FIG. 4, it is clear that the balance among the tensile strength, and the rupture elongation or the Erichsen value in the steel of the present invention is very excellent. The photo-microscopic structure of the steel $Y_4$ in Example 4 is shown in FIG. 2.

EXAMPLE 5

Steels having chemical compositions shown in Table 6 were hot rolled at a finishing temperature of 870°C ± 20°C and a coiling temperature of 610°C ± 20°C, cold rolled and annealed under the conditions shown in Table 7. Mechanical properties and results of rough measurements of the dimensional ratio of the hard phases in the products obtained above are also shown in Table 7. All of the products were subjected to an aging treatment at 400°C during the cooling of the annealing, and 1.5% skin-pass rolling after the aging treatment.

EXAMPLE 6

Steels having chemical compositions shown in Table 8 were hot rolled, cold rolled and annealed under the conditions shown in Table 9 together with their mechanical properties. All of the products thus obtained were subjected to an overaging treatment at 400°C during the cooling of the annealing, and 1.5% skin-pass rolling after the overaging treatment. The photomicroscopic structure of the steel $W_2$ in Example 6 is shown in FIG. 1.

Table 1

| | Steel Designation | Chemical Composition (%) C | Si | Mn | P | S | sol. Al | O | Group A | Group B | Hot Rolling Conditions: Finishing Temp. (°C) | Coiling Temp. (°C) | Reduction of Cold Rolling (%) |
|---|---|---|---|---|---|---|---|---|---|---|---|---|---|
| Steels of Present Invention | A1 | 0.08 | 0.46 | 1.24 | 0.016 | 0.012 | 0.034 | 0.008 | | | 890 | 550 | 70 |
| | A2 | 0.11 | 0.26 | 0.92 | 0.010 | 0.010 | 0.026 | 0.006 | | | 910 | 710 | 65 |
| | A3 | 0.04 | 0.41 | 1.74 | 0.012 | 0.008 | 0.043 | 0.006 | Ni 0.18 | | 920 | 710 | 70 |
| | A4 | 0.09 | 0.59 | 1.46 | 0.010 | 0.007 | 0.028 | 0.005 | Cu 0.06 | Ca 0.02 (added amount) | 890 | 650 | 70 |
| | A5 | 0.07 | 0.64 | 1.63 | 0.016 | 0.010 | 0.088 | 0.008 | | | 910 | 710 | 70 |
| Comparative Steels | B1 | 0.10 | 0.53 | 1.62 | 0.014 | 0.010 | 0.028 | 0.006 | | | 890 | 600 | 70 |
| | B2 | 0.13 | 0.18 | 1.42 | 0.011 | 0.008 | 0.034 | 0.007 | Cr 0.21 | Zr 0.02 | 910 | 710 | 70 |
| | B3 | 0.14 | 0.32 | 1.04 | 0.016 | 0.014 | 0.029 | 0.008 | Cu 0.04 | | 910 | 550 | 70 |
| | B4 | 0.20 | 0.68 | 1.28 | 0.014 | 0.013 | 0.036 | 0.009 | | | 890 | 580 | 80 |
| | B5 | 0.02 | 0.84 | 1.10 | 0.011 | 0.009 | 0.028 | 0.009 | Cu 0.05 | | 910 | 580 | 70 |

| Annealing Method | Annealing Temp. (°C) | Overageing Temp. (°C) | Mechanical Properties: Yield point (kg/mm²) | Tensile strength (kg/mm²) | Yield point / Tensile strength | Rature elongation (%) | $\bar{r}$ Value | Limit Drawing ratio (Impact secondary working test) |
|---|---|---|---|---|---|---|---|---|
| Continue | 700 | 350 | 40.4 | 53.8 | 0.76 | 31.3 | 1.28 | 2.9 |
| " | 700 | 350 | 36.8 | 49.1 | 0.75 | 35.4 | 1.24 | 3.0 |
| " | 700 | 300 | 48.8 | 62.3 | 0.78 | 25.9 | 1.25 | 2.8 |
| " | 700 | 350 | 45.2 | 59.1 | 0.76 | 28.4 | 1.24 | 2.9 |
| " | 700 | 350 | 47.6 | 61.2 | 0.78 | 26.9 | 1.22 | 2.8 |
| Box | 700 | — | 35.2 | 57.2 | 0.62 | 28.4 | 1.29 | 2.9 |
| " | 700 | — | 33.8 | 53.9 | 0.63 | 31.6 | 1.28 | 2.9 |
| " | 700 | — | 30.7 | 49.1 | 0.63 | 35.2 | 1.26 | 2.9 |
| " | 700 | — | 36.8 | 63.4 | 0.58 | 23.3 | 1.23 | 2.6 |
| Continue | 700 | 400 | 30.8 | 47.8 | 0.64 | 36.8 | 1.03 | 2.7 |

Remarks
*Annealing Heating Rate 5.8°C/sec.
*Cooling Rate after Annealing 4.2°C/sec.
*Annealing Holding Time 2 min.
*Overaging Holding Time 10 min.

Table 2.

| Steel Designation | Chemical Composition (%) C | Si | Mn | P | S | sol. Al | O | Group A | Group B | Hot Rolling Condition: Finishing Temp. (°C) | Coiling Temp. (°C) | Primary Cold Rolling Reduction (%) |
|---|---|---|---|---|---|---|---|---|---|---|---|---|
| A6 | 0.06 | 0.38 | 1.06 | 0.012 | 0.009 | 0.036 | 0.009 | | Ca 0.02 (added amount) | 890 | 650 | 60 |
| A7 | 0.14 | 0.34 | 1.21 | 0.016 | 0.009 | 0.028 | 0.009 | | | 890 | 550 | 60 |
| A8 | 0.09 | 0.28 | 1.37 | 0.010 | 0.010 | 0.040 | 0.006 | Ni 0.05 | | 920 | 650 | 60 |

| Primary Annealing: Annealing method | Annealing Temp. (°C) | Secondary Cold Rolling Reduction (%) | Secondary Continuous Annealing Temp. (°C) | Overaging Temp. (°C) | Mechanical Properties: Yield point (kg/mm²) | Tensile strength (kg/mm²) | Yield point / tensile strength | Rature elongation (%) | $\bar{r}$ Value | Limit Drawing ratio (Impact secondary working test) |
|---|---|---|---|---|---|---|---|---|---|---|
| Box | 600 | 70 | 700 | 350 | 38.9 | 51.6 | 0.75 | 34.9 | 1.64 | 3.0 |
| Continue | 700 | 60 | 700 | 350 | 39.8 | 52.9 | 0.75 | 33.3 | 1.64 | 2.9 |
| " | 850 | 70 | 700 | 300 | 40.8 | 53.2 | 0.77 | 32.6 | 1.59 | 3.0 |

Remarks:
Secondary Continuous Annealing Conditions
Annealing Heating Rate 5.8 °C/sec.
Annealing Holding Time 2 min
Cooling Rate after Annealing 4.2°C/sec.
Overaging Holding Time 10 min.

Table 3

| | Steel Designation | Chemical Composition (%) C | Si | Mn | P | S | O | solAl | Others |
|---|---|---|---|---|---|---|---|---|---|
| Steels of Present Invention | S 1 | 0.18 | 0.420 | 1.45 | 0.012 | 0.009 | 0.007 | 0.024 | Cr 0.24 |
| | S 2 | 0.16 | 0.322 | 1.63 | 0.012 | 0.010 | 0.009 | 0.026 | |
| | S 4 | 0.17 | 0.185 | 1.24 | 0.018 | 0.010 | 0.008 | 0.018 | Ni 0.28 |
| | S 6 | 0.22 | 0.425 | 1.05 | 0.012 | 0.005 | 0.007 | 0.058 | Cu 0.04 |
| | S 7 | 0.09 | 0.584 | 1.94 | 0.011 | 0.010 | 0.006 | 0.033 | Rear Earth Element 0.04 (Added Amount) |
| Comparative Steel | T 1 | 0.02 | 0.044 | 1.40 | 0.012 | 0.010 | 0.007 | 0.033 | Cr 0.30 |
| | T 2 | 0.17 | 0.427 | 0.48 | 0.013 | 0.009 | 0.009 | 0.041 | Zr 0.03 Zr 0.04 |

| Mechanical Properties: Yield Point (kg/mm²) | Tensile Strength (kg/mm²) | Elongation (%) | Rutoture Elongation (%) | Ratio of Dimension of Hard Phase (%) | Erichsen Test Value (mm) |
|---|---|---|---|---|---|
| 43.6 | 59.8 | 22.8 | 34.0 | 19 | 10.7 |
| 44.2 | 60.4 | 22.0 | 34.2 | 18 | 10.6 |
| 39.8 | 54.8 | 24.8 | 37.5 | 16 | 11.1 |
| 37.1 | 52.6 | 25.6 | 38.8 | 18 | 11.2 |
| 48.1 | 65.8 | 20.8 | 30.9 | 17 | 10.5 |
| 26.5 | 41.2 | 22.9 | 40.7 | — | 10.5 |
| 26.4 | 40.3 | 23.7 | 40.7 | — | 10.6 |

Table 4

| Chemical Composition (%) C | Si | Mnn | P | S | solAl | O |
|---|---|---|---|---|---|---|
| 0.18 | 0.426 | 1.58 | 0.012 | 0.010 | 0.032 | 0.008 |

Table 6

| Chemical Composition (wt %) C | Si | Mn | P | S | solAl | O | B |
|---|---|---|---|---|---|---|---|
| 0.13 | 0.512 | 1.74 | 0.015 | 0.009 | 0.028 | 0.006 | 0.0010 |

Table 5

| Present Invention marked○ | Steel Designa-tion | Reduction of Cold Rolling (%) | Product Thickness (mm) | Annealing Conditions: Average Heating Rate (°C/sec) | Annealing Temperature (°C) | Annealing Holding Time (min.) | Average Cooling Rate Down to 500°C (°C/sec) |
|---|---|---|---|---|---|---|---|
| ○ | Y 1 | 65 | 1.0 | 4.3 | 800 | 2.9 | 3.0 |
| | Y 3 | 65 | 1.0 | 7.0 | 950 | 1.8 | 3.8 |
| ○ | Y 4 | 65 | 1.0 | 6.3 | 840 | 2.0 | 3.5 |
| ○ | Y 5 | 65 | 1.0 | 24.1 | 840 | 1.0 | 13.4 |
| | Y 6 | 65 | 1.0 | 0.5 | 800 | 21.0 | 0.2 |
| | Y 7 | 65 | 1.0 | 49.2 | 840 | 0.7 | 42.6 |

| Mechanical Properties: Yield Point (kg/mm²) | Tenoile Strength (kg/mm²) | Elongation (%) | Rupture Elongation (%) | Ratio of Dimension of Hard Phase (%) | Erichsen Test Value (mm) |
|---|---|---|---|---|---|
| 43.1 | 59.2 | 22.6 | 33.8 | 17 | 10.7 |
| 73.6 | 82.4 | 5.2 | 8.1 | — | 7.2 |
| 44.9 | 61.9 | 21.2 | 33.4 | 19 | 10.5 |
| 54.8 | 70.4 | 18.5 | 38.2 | 22 | 10.1 |
| 32.4 | 51.6 | 19.3 | 32.0 | — | 10.2 |
| 62.5 | 76.4 | 10.8 | 17.4 | — | 8.3 |

Table 7

| Present Invention marked○ | Steel Designa-tion | Reduction of Cold Rolling (%) | Product Thickness (mm) | Annealing Conditions: Average Heating Rate (°C/sec) | Annealing Temperature (°C) | Annealing Holding Time (min.) | Average Cooling Rate Down to 500°C (°C/sec) |
|---|---|---|---|---|---|---|---|
| ○ | W 2 | 65 | 1.0 | 4.3 | 800 | 2.9 | 3.0 |
| ○ | W 3 | 65 | 1.0 | 6.3 | 840 | 2.0 | 3.5 |
| | W 4 | 65 | 1.0 | 7.0 | 950 | 1.8 | 3.8 |
| | W 5 | 65 | 1.0 | 0.5 | 780 | 21.0 | 0.2 |
| ○ | W 6 | 65 | 1.0 | 22.4 | 800 | 1.0 | 12.8 |

Table 7-continued

| Present Invention marked O | Steel Designation | Reduction of Cold Rolling (%) | Product Thickness (mm) | Annealing Conditions: Average Heating Rate (°C/sec) | Annealing Temperature (°C) | Annealing Holding Time (min.) | Average Cooling Rate Down to 500°C (°C/sec) |
|---|---|---|---|---|---|---|---|
| | W 7 | 65 | 1.0 | 49.2 | 840 | 0.7 | 42.6 |

| Mechanical Properties: Yield Point (kg/mm²) | Tenoile Strength (kg/mm²) | Elongation (%) | Rupture Elongation (%) | Ratio of Dimension of Hard Phase (%) | Erichsen Test Value (mm) |
|---|---|---|---|---|---|
| 52.8 | 69.2 | 18.3 | 28.1 | 16 | 10.2 |
| 59.6 | 75.2 | 15.9 | 26.3 | 20 | 9.8 |
| 84.6 | 93.2 | 3.6 | 5.8 | — | 6.3 |
| 37.8 | 54.6 | 18.1 | 30.2 | — | 10.1 |
| 68.4 | 82.6 | 14.2 | 22.1 | 15 | 9.7 |
| 71.6 | 85.8 | 8.6 | 13.9 | — | 8.2 |

Table 8

| Chemical Composition (wt %): C | Si | Mn | P | S | solAl | O | (P%)+(Si%) | (P%)/(C%) | (Si%)/(C%) |
|---|---|---|---|---|---|---|---|---|---|
| 0.12 | 0.492 | 1.52 | 0.036 | 0.009 | 0.026 | 0.007 | 0.528 | 0.30 | 4.10 |

Table 9

| Present Invention marked O | Steel Designation | Reduction of cold Rolling (%) | Product Thickness (mm) | Annealing Conditions: Average Heating Rate (°C/sec) | Annealing Temperature (°C) | Annealing Holding Time (min.) | Average Cooling Rate Down to 500°C (°C/sec) |
|---|---|---|---|---|---|---|---|
| O | W 2 | 70 | 1.2 | 4.2 | 750 | 3.0 | 2.4 |
| | W 5 | 70 | 1.2 | 0.5 | 750 | 8.9 | 0.7 |
| | W 6 | 70 | 1.2 | 21.5 | 750 | 0.5 | 12.6 |
| | W 7 | 70 | 1.2 | 0.2 | 750 | 15.5 | 0.3 |
| O | W10 | 60 | 1.2 | 6.3 | 780 | 2.0 | 3.5 |
| O | W11 | 70 | 1.2 | 3.6 | 750 | 8.0 | 0.8 |

| Mechanical Properties: Yield Point (kg/mm²) | Tenoile Strength (kg/mm²) | Rupture Elongation (%) | Erichsen Test Value (mm) |
|---|---|---|---|
| 52.4 | 64.6 | 34.7 | 10.5 |
| 43.6 | 57.2 | 28.6 | 9.7 |
| 54.9 | 63.8 | 26.4 | 9.3 |
| 38.6 | 52.4 | 32.6 | 10.2 |
| 53.6 | 66.4 | 33.8 | 10.4 |
| 51.6 | 62.5 | 35.2 | 10.6 |

What is claimed is:

1. A method for producing a cold rolled steel sheet having high strength and press formability which comprises hot rolling a steel containing 0.03 to 0.30% C, less than 0.7% Si, 0.6 to 2.5% Mn, 0.01 to 0.20% sol.Al, not more than 0.15% 0 with the balance being Fe and unavoidable impurites, cold rolling with a reduction not less than 30%, heating with an average heating rate not less than 3°C/sec. annealing in a temperature range from 650°C to $A_3$ transformation point for 1 to 15 minutes, and cooling with an average cooling rate of 0.5 to 30°C/sec. down to 500°C.

2. The method according to claim 1, in which the annealing is done between the $A_1$ transformation point and $A_3$ transformation point.

3. The method according to claim 1, in which the annealing is done between the $A_1$ transformation point and 790°C.

4. A method for producing a cold rolled steel sheet having high strength and press formability which comprising hot rolling a steel containing 0.06 to 0.25% C, 1.0 to 2.5% Mn, 0.01 to 0.20% sol.Al, not more than 0.015% O, P and Si in an amount to satisfy the condition of $0.05\% \leq (P\%)+(Si\%) \leq 0.7$ and one or both of the conditions of $(P\%)/(C\%) \geq 0.5$ and $(Si\%)/(C\%) \geq 1$ with the balance being Fe and unavoidable impurities, cold rolling with a reduction not less than 50%, heating with an average heating rate not less than 3°C/sec. annealing in a temperature range from $A_1$ transformation point to 790°C for 1 to 10 minutes and cooling with an average cooling rate between 0.5 and 30°C/sec. down to 500°C.

5. The method according to claim 1 in which the average cooling rate down to 500°C is 0.5 to 10°C/sec.

6. A method for producing a cold rolled steel sheet having high strength and press formability which comprises hot rolling a steel containing 0.03 to 0.30% C, less than 0.7% Si, 0.6 to 2.5% Mn, 0.01 to 0.20% sol.Al, not more than 0.015% 0 with the balance being Fe and unavoidable impurities, cold rolling with a reduction not less than 40%, recrystallization annealing, again cold rolling with a reduction not less than 40%, heating with a heating rate not less than 3°C/sec., annealing in a temperature range from 650°C to $A_3$ transformation point for 1 to 15 minutes, and cooling with an average cooling rate between 0.5 and 30°C/sec. down to 500°C.

7. The method of claim 1 in which the steel further comprises 0.0005 to 0.01 % B.

8. The method of claim 1 in which the steel further comprises one or more of the group A consisting of Cr, Ni and Cu and one or more of the group B consisting of Zr, rare earth elements, Ca and Mg, in a total amount of 0.03 to 1.0% for the group A elements and 0.01 to 0.1 % for the group B elements.

* * * * *